United States Patent [19]

Hills

[11] 4,269,791

[45] May 26, 1981

[54] HYDROGEN-OXYGEN MIXER APPARATUS AND PROCESS

[75] Inventor: Brian A. Hills, Houston, Tex.

[73] Assignee: The United States of America as represented by the Secretary of the Navy, Washington, D.C.

[21] Appl. No.: 851,243

[22] Filed: Nov. 14, 1977

[51] Int. Cl.[3] ..... B01F 3/04

[52] U.S. Cl. ..... 261/36 R; 128/200.13; 261/124; 261/DIG. 65; 405/186

[58] Field of Search ..... 261/29, 36 R, 76, 77, 261/123, 124, DIG. 75, DIG. 65, 93; 128/142 G, 142.3, 197, 209; 61/69 R, 70; 55/83–85, 89, 226; 405/185–193

[56] References Cited

U.S. PATENT DOCUMENTS

| | | | |
|---|---|---|---|
| 2,289,953 | 7/1942 | Aldridge | 261/77 X |
| 3,450,800 | 6/1969 | Smith et al. | 261/76 X |
| 3,497,185 | 2/1970 | Dively | 261/36 R |
| 3,562,349 | 2/1971 | Pawloski et al. | 261/36 R X |
| 3,710,549 | 1/1973 | Nichols et al. | 261/36 R X |
| 3,799,511 | 3/1974 | Svantesson | 261/123 X |
| 3,834,682 | 9/1974 | McPhee | 261/123 |
| 3,870,470 | 3/1975 | Yoshida et al. | 261/123 |
| 3,924,618 | 12/1975 | Banjavich et al. | 61/69 R X |
| 3,957,442 | 5/1976 | Yamamoto et al. | 261/36 R X |
| 4,029,724 | 6/1977 | Muller et al. | 261/93 X |

FOREIGN PATENT DOCUMENTS

| | | | |
|---|---|---|---|
| 694918 | 7/1953 | United Kingdom | 261/DIG. 75 |

*Primary Examiner*—Richard L. Chiesa

[57] ABSTRACT

An improved technique is described for providing a mixture of a plurality of gases to be used for diving and other applications. More specifically, the technique provides for the mixture of such gases as hydrogen and oxygen while decreasing the likelihood of explosion during mixing. In particular, hydrogen and oxygen bubbles are introduced into a column of liquid through needle injectors positioned in a region of turbulent liquid flow. The liquid flow is maintained such that the bubbles from the injectors are forced through a series of baffles which gradually decrease the turbulence as the gases mix by equilibriation. When hydrogen and oxygen are mixed, the hydrogen and oxygen are maintained at a ratio of 95:5 $H_2$-$O_2$ such that the final concentration of gas is in the nonexplosive range. In addition, the fluid column confines any explosive mixture (produced by direct bubble contact) to the individual bubble volume enclosed by the liquid boundary.

5 Claims, 1 Drawing Figure

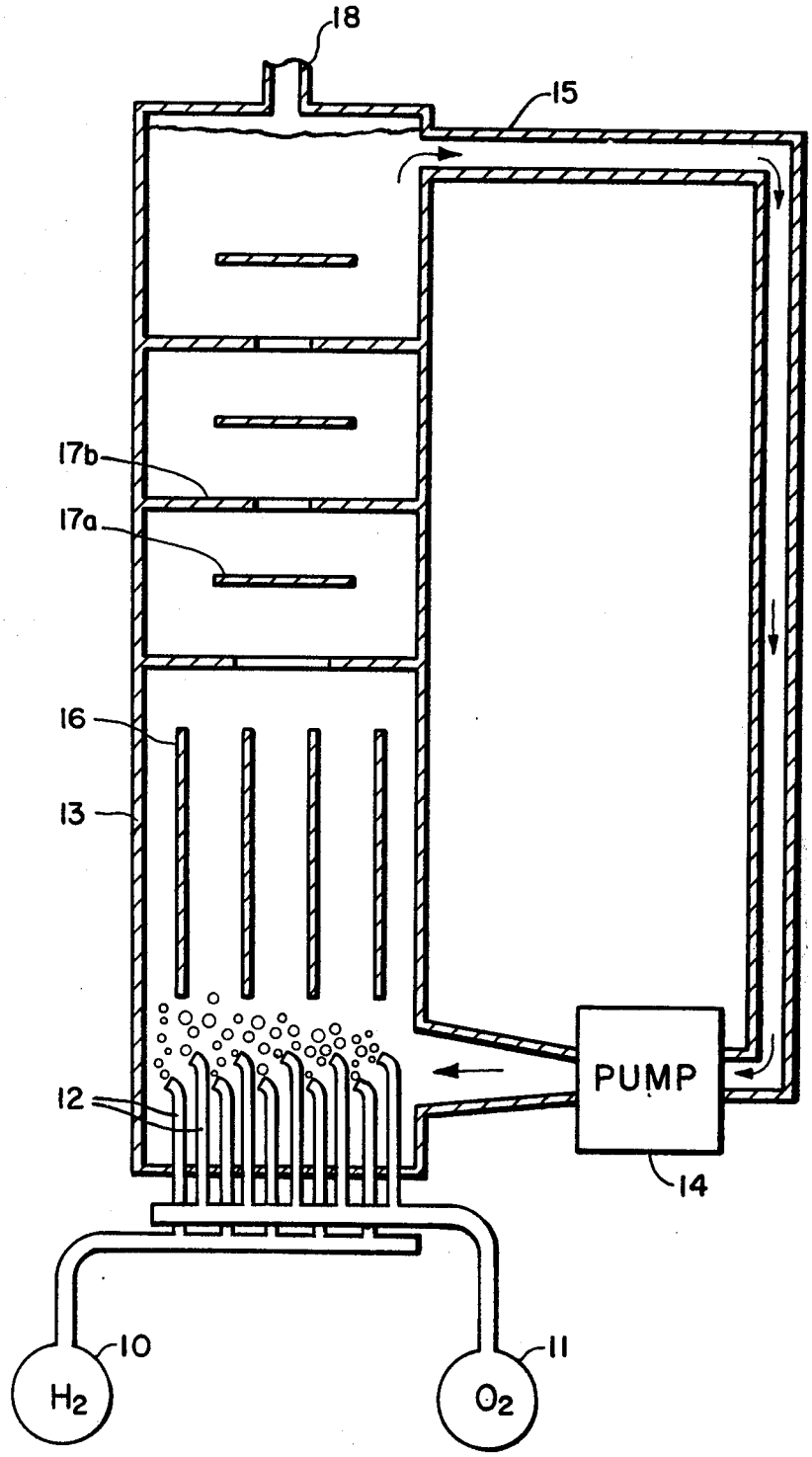
18
15
17b
17a
16
13
12
PUMP
14
10
11
$H_2$
$O_2$

HYDROGEN-OXYGEN MIXER APPARATUS AND PROCESS

BACKGROUND OF THE INVENTION

The present invention relates to a method of mixing a plurality of gases and more particularly to an improved technique for minimizing the possibility of explosion during the mixing of such gases as hydrogen and oxygen.

In particular arts, it is often necessary to provide a homogeneous combination of gases by mixing a plurality of individual gases. By way of example, the diving art requires that a different combination of gases be employed as dives are made to greater depths. Generally, the use of air as a diving gas has been limited to the 250–300 foot range where the occurrence of nitrogen narcosis begins to inhibit diver efficiency. Pure oxygen exhibits toxic effects at depths greater than 150 feet and has therefore also been unsuitable for use in deep dives. Consequently, the primary breathing gas for diving purposes has been a mixture of helium and oxygen for depths greater than 200–300 feet. In this combination, the helium provides a suitable breathing mixture with oxygen by inhibiting narcosis at diving pressures and exhibiting a lower solubility than nitrogen in both fatty and aqueous tissues to thereby reduce the decompression time needed to avoid "the bends". However, for deep and long duration dives, large amounts of helium are required. Since the supply of helium is limited, the cost has increased significantly as the demand has increased, thereby making the use of helium economically prohibitive.

As an alternative, hydrogen has been proposed as a substitute for helium in deep and long duration dives. Hydrogen provides similar benefits to those of helium by reducing the effects of narcosis and exhibiting a low density for easy breathing. In addition, even though hydrogen is more soluble than helium or nitrogen, it has a higher diffusivity which can be advantageous for long duration dives. However, in spite of the fact that the technology has been available to inexpensively produce and safely handle and store hydrogen as a liquid, its use with oxygen as a diving mixture has been restricted due to the explosive nature of hydrogen-oxygen mixtures having a percentage of oxygen greater than 6 percent.

As is known, in order to provide for the possible mixing of hydrogen and oxygen, the 6% oxygen limitation must be maintained at all times in order to avoid the possibility of explosion. In any mixing technique, however, there tends to be a volume of the mixture which will initially have a higher concentration of one gas until the other gas is dispersed evenly throughout the total volume. Therefore, while a variety of techniques have been proposed to enable the mixing of such gases, none have been able to reduce the danger of explosion below an acceptable level so that an on-site generation of the diving mixture could be safely employed. There is thus a continuing need to provide inexpensive techniques for mixing a plurality of gases and, more particularly, for enabling the use of hydrogen as a diving gas wherein its use with oxygen would normally produce an explosive combination of gases.

Accordingly, the present technique has been developed to overcome the specific shortcomings of the above-known and similar techniques and to provide an improved system for mixing precise quantities of hydrogen and oxygen.

SUMMARY OF THE INVENTION

It is therefore an object of the present invention to provide a technique for mixing specific ratios of a plurality of gases.

Another object of the invention is to provide a technique for mixing gases using a plurality of small bubbles.

It is a further object of the invention to provide a technique for minimizing the likelihood of explosion during the production of gas mixtures transcending an explosive region.

Still another object of the invention is to provide a system and technique for mixing hydrogen and oxygen by maintaining quantities of each gas in a turbulent flow of liquid.

Yet another object of the invention is to minimize and retain explosive mixtures of hydrogen and oxygen in a small volume surrounded by a liquid medium during mixing.

In order to accomplish the above and other objects, the invention employs a plurality of needle injectors which provide each gas to a column of liquid. The needle injectors are coupled to sources of the gases to be mixed, such as hydrogen and oxygen, and regulated so that the total volume of gas delivered to the injectors will be maintained at a specific ratio for controlling the end mixture. The column of liquid is then caused to have a turbulent flow at one portion to provide a mixing region for the gases. The gases in the turbulent region transfer through the liquid boundary between the bubbles in the column of liquid until equilibriation occurs. By passing the bubbles through a series of baffles, the resistance to gas transfer is initially minimized to cause safe equilibriation until the turbulence gradually decreases and the equilibriated bubbles exit from a less turbulent region of the liquid column. Since any explosion could only occur when bubbles directly collide with one another, the volume of gas subject to explosion would be small and would be contained in the minute chambers formed by the liquid walls surrounding the bubbles. The final gas concentration at the output of the mixing chamber may then be used to directly supply the correct ratio of gas mixture for use on site.

Other objects, advantages, and novel features of the invention will become apparent from the following detailed description when taken with the accompanying drawing wherein:

BRIEF DESCRIPTION OF THE DRAWING

The FIGURE is a schematic diagram of the gas mixing system constructed in accordance with the present invention.

DETAILED DESCRIPTION OF A PREFERRED EMBODIMENT

The apparatus for providing a mixture of a plurality of gases according to the present invention includes a source 10 of a first gas such as hydrogen and a source 11 of a second gas such as oxygen, each coupled to a plurality of needle injectors 12. While only two sources have been shown in the present drawing, it is apparent that any number of sources could be employed to provide for the mixture of any desired number of gases. The injectors 12 are positioned at the base of a cylindrical enclosure 13 having vertical baffles 16 and horizontal disc or doughnut baffles 17*a* and 17*b*, respectively, attached to the walls to form impediments to the flow of liquid therethrough. The enclosure may be formed from any conventional material such as metal and is designed so that the baffles 16 and 17 act to separate and gradually reduce the turbulent flow of liquid from the base of the enclosure 13 to the top of the same enclosure having an exit opening at 18. A pump 14 is coupled to the same base of the enclosure 13 to provide a flow of liquid into the base of the enclosure and thereby provide a column of liquid throughout the length of the enclosure 13. In addition, an outlet pipe 15 is coupled from a position at the top of the enclosure 13 to provide a return path for the liquid to the pump 14 so that a continuous flow is provided throughout the enclosure 13. The pump therefore acts to circulate liquid from the base of the enclosure 13 through the baffles 16 and 17 and through the return pipe 15. As can be seen, in order to provide a space for the collection of the gaseous mixture at the top of the enclosure, the output port 15 may be positioned at a distance below the top of the enclosure 13, although such positioning is not required since the gas could exit directly through outlet 18.

In operation, the pump 14 provides the turbulent flow of liquid, in this case water, to the base of the enclosure 13. The flow of water impinges upon the vertical baffles 16 and horizontal baffles 17 which gradually decrease the turbulence until the water reaches the return port 15 at the top of the enclosure. The sources 10 and 11 provide hydrogen and oxygen to the needle injectors 12 such that minute bubbles are introduced into the water flow at the position of greatest turbulence. While the diameter of the injectors can be controlled to produce any desirable diameter bubble, for hydrogen and oxygen the bubbles will generally be maintained in a range of between 50 and 100 $\mu$m in diameter so that equilibriation of the gases throughout the water boundary will occur very quickly. Each bubble formed and injected into the liquid column under these conditions acts as a minute mixing chamber with liquid walls totally isolating each of the other bubbles. As the bubbles pass through the column to the vertical and horizontal baffles and into successively less turbulent regions, transfer of gas across the fluid boundary between bubbles causes equilibriation of the bubbles (e.g. mixing in the supplied ratio) until they break the surface and mix with gases from other equilibriated bubbles. The mixture is then withdrawn from the system at exit port 18 where it may be used to continuously supply gas for other purposes as may be required. The length of the water column must be such as to allow substantially complete equilibriation between bubbles to occur over the distance traveled by the bubbles prior to their withdrawal. At the same time, the liquid will be continuously recycled by the pump 14 to maintain the turbulent flow as is required to provide the desired mixing.

Since the hydrogen and oxygen are injected separately into the column of liquid and are continuously stirred by the flow of liquid in the turbulent region, each microbubble forms an individual mixing chamber. As such, each is totally isolated from that of the other volumes formed by all other individual bubbles. In the liquid environment, the transfer of gas between any bubble is limited only by the liquid area immediately adjacent to any given bubble and the next adjacent bubble. The resistance to such gas exchange presented by the liquid boundary is minimized by maintaining the noted turbulent flow where the bubbles are injected. When the gas mixture is provided at a specific ratio from the sources 10 and 11 (in this case 95:5 percent $H_2$-$O_2$) the bubbles will equilibriate to provide the same ratio in the final mixture. As was noted, for hydrogen-oxygen mixtures, this is particularly important since any mixture exceeding 6 percent oxygen could be explosive.

While the present technique may result in the collision of bubbles wherein the total volume mixture following collision exceeds the 95:5 percent $H_2$-$O_2$ ratio, the total number of bubbles which are capable of entering this explosive region is limited by the 5 percent $0_2$. Thus, only 5% of the bubbles for any mixture of hydrogen and oxygen are capable of causing an explosive situation. According to the present technique, however, even the mixture of such microbubbles by direct collision with others, rather than by equilibriation through solution, will not result in any significant explosive problems since the technique will limit the explosive region to the bubble volume surrounded by its own liquid boundary. Since each bubble is isolated from all other bubbles, there will be no continuous gas phase between the source of pure hydrogen, the source of pure oxygen, and the final mixture, thereby limiting the explosion to a small and nonhazardous volume.

As can be seen from the above description, the inventive apparatus and technique provides a simple and efficient method for enabling the on-site mixing of gases, particularly hydrogen and oxygen, which are to be used for diving purposes. The same technique may be used for any number of gases for which it may be necessary to restrict the final ratio of the mixture and to isolate individual volumes of gases to avoid explosion or other harmful effects. In the particular instance described, the flow of hydrogen and oxygen to the needle injectors may be controlled such that the size of the bubbles in the most turbulent region will prevent significant explosions even for direct collision of pure hydrogen and oxygen bubbles. The diffusivity of hydrogen in water for any particular pressure facilitates gas transfer for equilibriation at the required gas ratio and may be controlled by further modification of the turbulent conditions at the base of chamber 13. In addition, by changing the water properties (e.g. by the addition of inorganic carriers which may chemically facilitate diffusion and convection in water) the diffusivity or permeability of the boundary layer for each gas may be decreased to further accelerate the transfer of any gas through the water boundary between the bubbles. The apparatus is thus able to provide the required mixture without the introduction of outside contaminants.

The present technique is also adaptable to various requirements of the particular end use of the gases. In the situation where hydrogen and oxygen are to be mixed to provide diving gases for on-site use, it is often necessary to eliminate the water vapor in the final mixture. For this purpose, the present invention facilitates the employment of a conventional gas drying unit which has been used in the diving industry. The unit can be directly attached to the output port 18 and then coupled to supply the mixture following removal of the water vapor. In addition, the present technique enables an alternative source to be used in conjunction with the system in case of operational failure. The present device may be constructed to provide for automatic disengagement of the system in the event of pump failure so that an alternative helium-oxygen mixture could be used. This would allow for safe transfer of gas supply when the likelihood of explosion would increase due to the loss of turbulent mixing.

While the invention has been described with particular reference to the apparatus shown in the FIGURE, it is apparent that other mixing and injection techniques could be employed to provide the required equilibriation between the gas bubbles. The device can be used to provide on-site mixtures of hydrogen-oxygen or any other gases for storage or on-site use that would normally exhibit explosive tendencies following mixing. Obviously, other modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A method for providing a mixture of gases for diving comprising:
   forming a column of liquid;
   inducing a region of turbulent flow in a portion of said liquid column;
   introducing bubbles of a first gas into said region;
   separately introducing bubbles of at least one different gas into the same region, said bubbles being introduced into said turbulent region such that gas transfer between the bubbles produces a mixture of said first and at least one different gas by equilibriation between the bubbles within the liquid;
   withdrawing a mixture of said first and at least one different gas from said column of liquid; and
   providing said mixture as a breathing gas for diving.

2. An apparatus for providing a mixture of multiple gases comprising:
   means for providing a column of liquid;
   means for inducing a turbulent flow at one end of said column and decreasing said turbulence along said column to the opposite end;
   means for introducing bubbles of a plurality of gases into said region of turbulent flow such that gas transfer between the bubbles produces a mixture of said plurality of gases by equilibriation between the bubbles within the liquid, said means for introducing including,
   a source of hydrogen and a source of oxygen each coupled to a plurality of needle injectors positioned to provide said gas bubbles to said turbulent region, and
   means for extracting a mixture of said hydrogen and said oxygen from the region of decreased turbulence.

3. An apparatus for providing a mixture of multiple gases comprising:
   means for providing a column of liquid;
   means for inducing a turbulent flow at one end of said column and decreasing said turbulence along said column to the opposite end;
   means for introducing bubbles of a plurality of gases into said region of turbulent flow such that gas transfer between the bubbles produces a mixture of said plurality of gases by equilibriation between the bubbles within the liquid, said means for introducing including,
   a source of hydrogen and a source of oxygen coupled to individual needle injectors to supply said gases to said turbulent region in a ratio not exceeding 6% oxygen, and
   means for extracting a mixture of said hydrogen and said oxygen from the region of decreased turbulence.

4. A method for mixing a plurality of gases comprising:
   forming a column of liquid;
   inducing a region of turbulent flow in a portion of said liquid column;
   introducing bubbles of hydrogen into said region;
   separately introducing bubbles of oxygen into the same region, said bubbles being introduced into said turbulent region such that gas transfer between the bubbles produces a mixture of said hydrogen and oxygen by equilibriation between the bubbles within the liquid; and
   withdrawing a mixture of said hydrogen and oxygen from said column of liquid.

5. A method for mixing a plurality of gases comprising:
   forming a column of liquid;
   inducing a region of turbulent flow in a portion of said liquid column;
   introducing bubbles of hydrogen into said region;
   separately introducing bubbles of oxygen into the same region, said hydrogen and oxygen being in a ratio not exceeding 6% oxygen and said bubbles being introduced into said turbulent region such that gas transfer between the bubbles produces a mixture of said hydrogen and oxygen by equilibriation between the bubbles within the liquid; and
   withdrawing a mixture of said hydrogen and oxygen from said column of liquid.

* * * * *